US006217020B1

(12) United States Patent
Supron et al.

(10) Patent No.: US 6,217,020 B1
(45) Date of Patent: Apr. 17, 2001

(54) METHOD AND APPARATUS FOR DETECTING PROPER MAILPIECE POSITION FOR FEEDING

(75) Inventors: Steven A. Supron, Middlebury; Gary S. Jacobson, Norwalk; Eric A. Belec, Southbury; Francesco Porco, Fairfield; David E. Kayser, Middlebury; Christopher J. Stefan, Derby; Martin Mulroy, Bridgeport, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/468,645

(22) Filed: Dec. 21, 1999

(51) Int. Cl.[7] ..... B65H 1/02
(52) U.S. Cl. ..... 271/149; 271/153
(58) Field of Search ..... 271/149, 150, 271/152, 153, 154, 155, 110

(56) References Cited

U.S. PATENT DOCUMENTS

| | | | | |
|---|---|---|---|---|
| 3,817,516 | | 6/1974 | Lazzarotti et al. | 271/150 |
| 4,302,000 | * | 11/1981 | Frank | 271/150 |
| 4,757,985 | | 7/1988 | Hamant et al. | 271/31.1 |
| 5,069,440 | | 12/1991 | Lazzarotti et al. | 271/202 |
| 5,697,610 | | 12/1997 | Holmes et al. | 271/263 |
| 5,829,742 | | 11/1998 | Rabindran et al. | 271/150 |
| 5,934,666 | | 8/1999 | Rabindran et al. | 271/148 |
| 6,032,946 | * | 3/2000 | Marshall et al. | 271/152 |

FOREIGN PATENT DOCUMENTS

| | | | |
|---|---|---|---|
| 0 868 227 | 8/1999 | (EP) | B07C/1/02 |
| WO 97/22425 | 6/1997 | (WO) | B07C/1/02 |

* cited by examiner

*Primary Examiner*—David H. Bollinger
(74) *Attorney, Agent, or Firm*—Alberta A. Vitale; Michael E. Melton; Robert E. Meyer

(57) ABSTRACT

The present invention is directed to, in a general aspect, a nudger for a mixed mail feeder and, in particular, to an apparatus and method of providing and detecting proper position in a stack of mixed mail. The apparatus, generally, comprises a nudger arm for detecting proper positioning of the mailpiece and a lean detection arm for detecting proper lean of the mailpiece with respect to the nudger. The method comprises generally, a determination that when the lean detection arm and the nudger arm are in a position indicating that the lead mailpiece is in the proper position, the stack of mixed mail is decelerated and fed to, for example, a separator, for further processing. The deceleration is performed at a slow rate and provides for a predetermined amount of over travel by the stack of mixed mail. This ensures proper contact of the lead mailpiece with the nudger rollers for feeding the mailpieces for further processing. The nudger rollers continue to feed the lead mailpieces until one or both of the lean detection arm and the nudger arm move out of the position(s) for proper mailpiece feeding.

10 Claims, 11 Drawing Sheets

METHOD AND APPARATUS FOR DETECTING PROPER MAILPIECE POSITION FOR FEEDING

FIELD OF THE INVENTION

The invention disclosed herein relates generally to an apparatus for feeding and separation of mixed mailpieces and, more particularly, to an apparatus and method for detecting and providing proper position of a stack of mail pieces.

BACKGROUND

The processing and handling of mailpieces consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be collected, sorted, addressed, and franked as part of the outgoing mail process. Additionally, incoming mail needs to be collected and sorted efficiently to ensure that it gets to the addressee in a minimal amount of time. Since much of the documentation and information being conveyed through the mail system are critical in nature relative to the success of a business, it is imperative that the processing and handling of both the incoming and outgoing mailpieces be done efficiently and reliably so as not to negatively impact the functioning of the business.

In view of the above, various automated mail handling machines have been developed for processing mail (removing individual pieces of mail from a stack and performing subsequent actions on each individual piece of mail). However, in order for these automatic mail handling machines to be effective, they must process and handle "mixed mail." The term "mixed mail" is used herein to mean sets of intermixed mailpieces of varying size, thickness, and weight. In addition, the term "mixed mail" also includes stepped mail (i.e. an envelope containing therein an insert which is smaller than the envelope to create a step in the envelope), tabbed and untabbed mail products, and mailpieces made from different substrates. Thus, the range of types and sizes of mailpieces which must be processed is extremely broad and often requires tradeoffs to be made in the design of mixed mail feeding devices in order to permit effective and reliable processing of a wide variety of mixed mailpieces.

In known mixed mail handling machines which separate and transport individual pieces of mail away from a stack of mixed mail, the stack of "mixed mail" is first loaded onto some type of conveying system for subsequent sorting into individual pieces. The stack of mixed mail is moved as a stack by an external force to, for example, a shingling device. The shingling device applies a force to the lead mailpiece in the stack to initiate the separation of the lead mailpiece from the rest of the stack by shingling it slightly relative to the stack. The shingled mailpieces are then transported downstream to, for example, a separating device which completes the separation of the lead mailpiece from the stack so that individual pieces of mail are transported further downstream for subsequent processing. In the mailing machine described immediately above, the various forces acting on the mailpieces in moving the stack (shingling the mailpieces, separating the mailpieces and moving the individual mailpieces downstream) often act in a counterproductive manner relative to each other. For example, inter-document stack forces exist between each of the mailpieces that are in contact with each other in the stack. The inter-document stack forces are created primarily by the weight of the stack and additionally by the stack advance mechanism, the frictional forces between the documents, and potentially electrostatic forces that may exist between the documents. The inter-document forces tend to oppose the force required to shear the lead mailpiece from the stack. Additionally, the interaction of the force used to drive the shingled stack toward the separator and the forces at the separator can potentially cause a thin mailpiece to be damaged by being buckled as it enters the separator. Furthermore, in a conventional separator, there are retard belts and feeder belts that are used to separate the mailpiece from the shingled stack. Both the forces applied by the retard belts and the feeder belts must be sufficient to overcome the inter-document forces previously discussed. However, the force of the retard belts cannot be greater than the force of the feeder belts, or the mailpieces will not be effectively separated and fed downstream to another mail processing device. Moreover, if the feeding force being applied to the mailpieces for presenting them to the separator is too great, another potential problem which may occur is that a plurality of mailpieces will be forced through the separator without the successful separation of the mailpieces.

Another condition that affects the feeding of mailpieces is vertical orientation of the stack of mixed mail. The preferred orientation in which the most successful feeding occurs is when mail is leaning slightly against a paddle of the stack feeding device. When the mail is in this orientation, stack forces created by the weight of the mail are very low, and the mail is more easily separated and aligned for feeding downstream into, for example, a separating device. The high stack forces are created by improperly loaded mail stacks or mail stacks that have shifted creating improper lean. The shifting can be caused by the inertia of the stack as it a incrementally advances to the shingling device. The high forces of the stack may also cause damage to mailpieces as they are fed out of the stack and can cause greater wear on the nudger or feed rollers. The high stack forces can also cause multifeeds. Additionally, improper alignment of leaning mail along the feed path to the separating device can cause the mail to stub as it enters the separating device and may also cause the mail to skew.

Thus, one of the problems of the prior art is that there can be failure to feed the mailpieces. Another problem of the prior art is that there can be poor separation of mail. Another problem of the prior art is that mail can be damaged by stubbing. Still another problem of the prior art is that multifeeds can occur when feeding mail. Yet another problem of the prior art is that stack forces can cause increased wear on feed rollers.

SUMMARY OF THE INVENTION

This invention overcomes the disadvantages of the prior art by providing a method and apparatus for detecting and providing proper mailpiece position when feeding mixed mailpieces. This in turn affords better mailpiece processing. The present invention is directed, in a general aspect, to a nudger for a mixed mail feeder and, in particular, to an apparatus and method of providing and detecting proper position in a stack of mixed mail. The apparatus generally comprises a nudger arm for detecting proper positioning of the mailpiece and a lean detection arm for detecting proper lean of the mailpiece with respect to the nudger. The apparatus helps to correct mailpiece lean which can cause the mailpiece not to feed. The method comprises, generally, a determination that when both the lean detection arm and the nudger arm are in a position indicating that the lead mailpiece is in the proper position, the stack of mixed mail is decelerated and fed to, for example, a separator, for further processing. The deceleration is performed at a slow rate and provides for a predetermined amount of over travel by the stack of mixed mail. This ensures proper contact of the lead mailpiece with the nudger rollers for feeding the mailpieces for further processing. The nudger rollers continue to feed the lead mailpieces until one or both of the lean detection arm and the nudger arm move out of the position(s) for proper mailpiece feeding, or a leading edge of the mailpiece blocks a downstream sensor.

Thus, an advantage of the present invention is that there is less failure to feed the mailpieces. Another advantage of the present invention is that consistent proper positioning of mailpieces for feeding is provided. Another advantage of the present invention is that less mailpiece damage occurs. Another advantage of the present invention is that less multi-feeds occur. Another advantage of the present invention is that there is less wear on feed rollers. Other advantages of the invention will in part be obvious and will in part be apparent from the specification. The aforementioned advantages are illustrative of the advantages of the various embodiments of the present invention.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
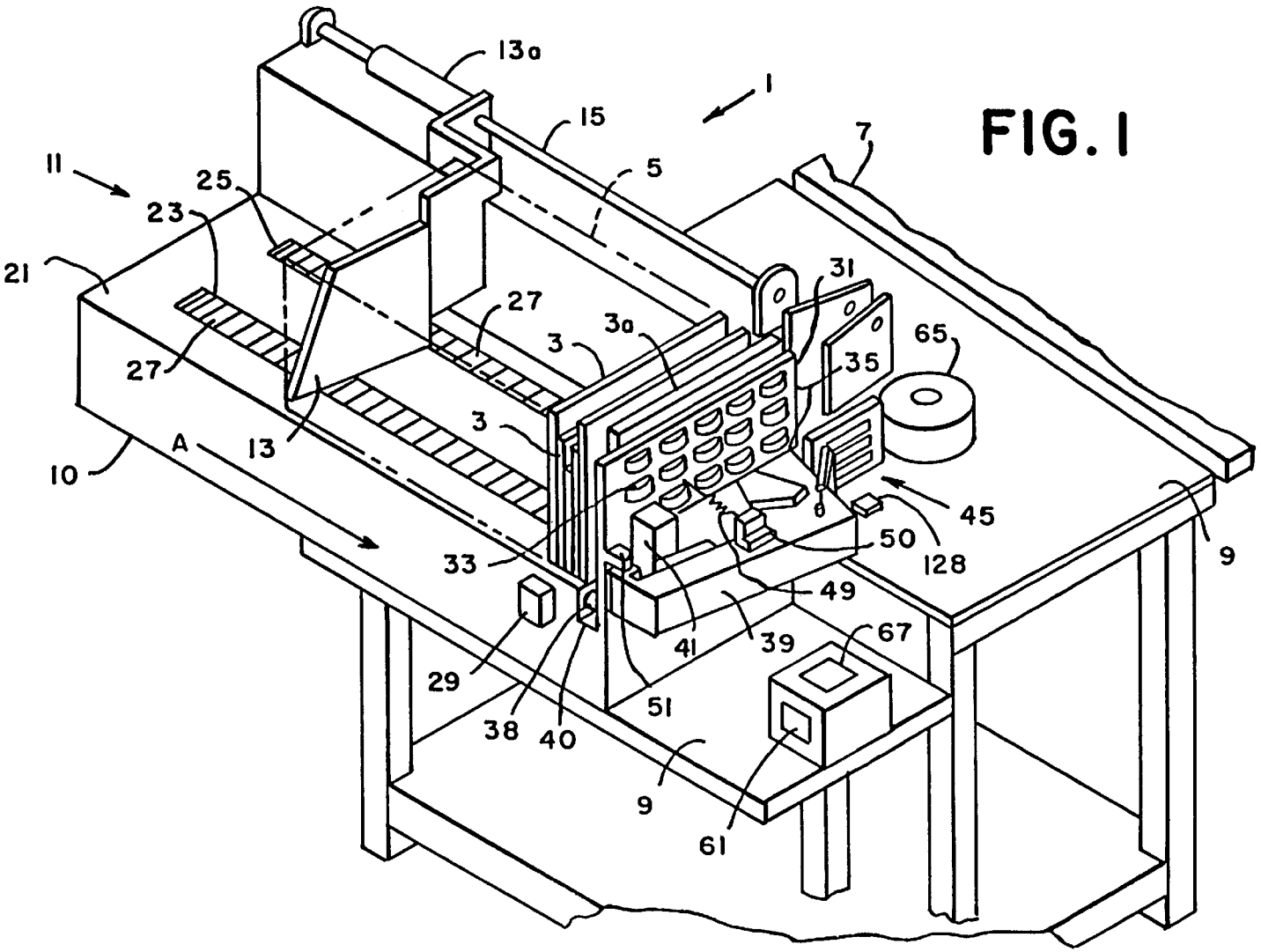
FIG. 1 is a perspective view of the inventive mail handling machine.
Figure 2:
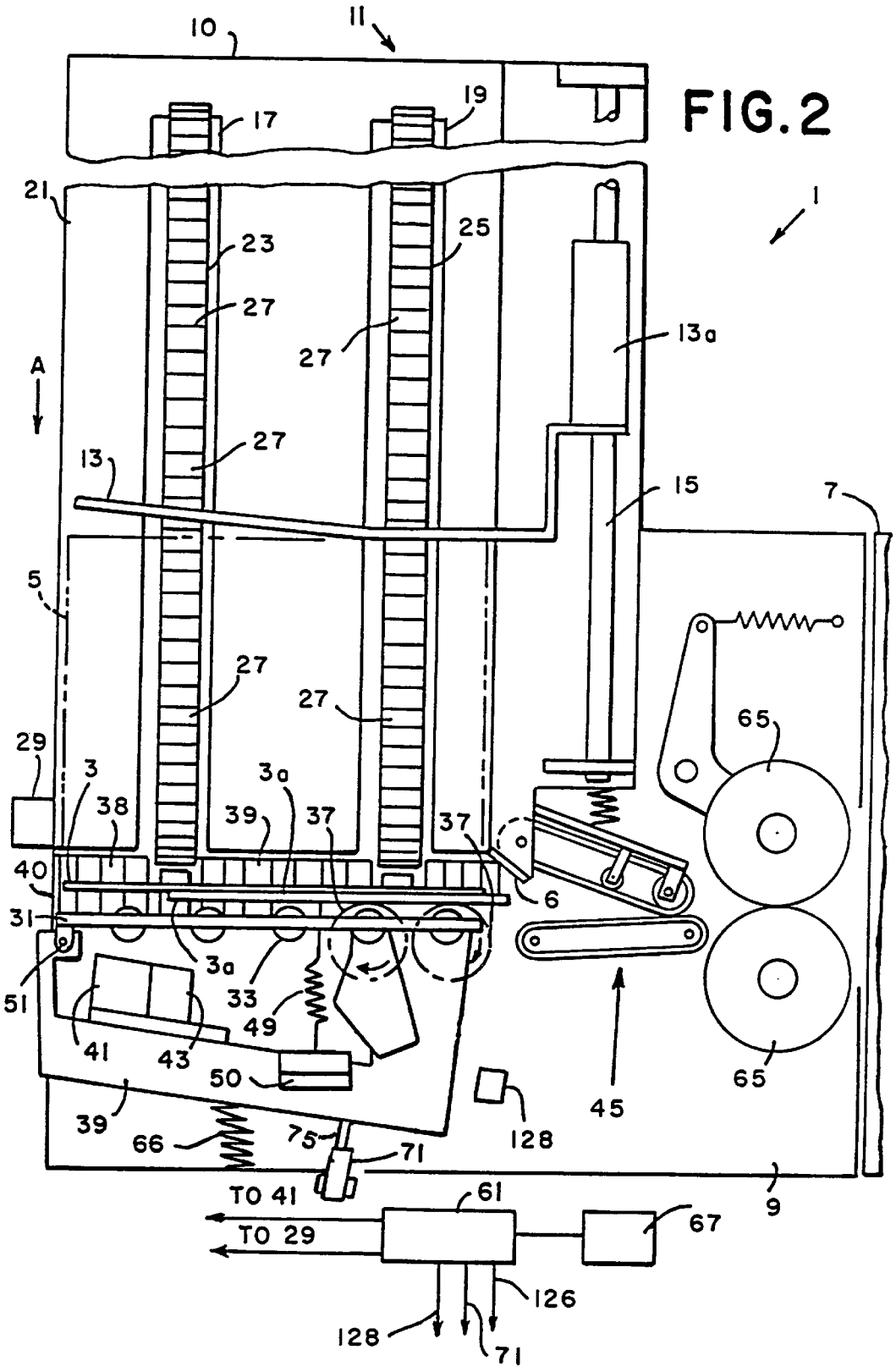
FIG. 2 is an enlarged to plan view of FIG. 1.

Referring to FIGS. 1 and 2, a mixed mail feeder 1 is shown. Mixed mail feeder 1, as will be discussed in more detail below, separates individual mailpieces 3 from a stack of mixed mail generally designated at 5 and transports the individual mailpieces 3 to a subsequent mail processing station 7. Mail processing station 7 can be any one of a plurality of devices such as a meter for printing postage on the mailpiece 3, an OCR reader for reading addresses off the mailpiece 3, a sorting device for sorting the individual mailpieces 3 to designated bins or areas, or even a scale that weighs the mailpiece. The key point is that the mixed mail feeder 1 functions to separate individual mailpieces 3 from a stack of mixed mail 5 and deliver the individual mailpieces 3 sequentially to the mail processing station 7.

Mixed mail feeder 1 includes a table 9 upon which all of the components of the mixed mail feeder 1 are mounted. At an input end of the mixed mail feeder 1, generally designated by the arrow 11, the stack of mixed mail 5 is placed on edge by an operator in front of a guide wall 13. Guide wall 13 acts as a support against which the stack of mixed mail 5 rests. Moreover, guide wall 13 includes a cylindrical portion 13*a* which is mounted to slide on a guide rod 15 fixedly attached to platform 10 which is mounted to table 9.

Platform 10 has first and second slots 17, 19, in a horizontal surface 21 thereof. The slots 17, 19 each permit a top portion of a respective individual continuous belt 23, 25 to project therethrough. Belts 23, 25 each have a plurality of individual track portions 27 over the full extent of the belts 23, 25. The bottom of guide wall 13 removably fits in adjacent track portions 27 of each of belts 23 and 25 so that guide wall 13 moves with belts 23, 25 in the direction of arrow A (alternatively, a single belt can be used). Moreover, as guide wall 13 moves in the direction of arrow A with the belts 23, 25, the cylindrical portion 13*a* slides along guide rod 15 to keep the standing orientation of guide wall 13 in the position shown in FIG. 1.

Continuous belts 23, 25 are mounted in a conventional manner around a pulley at each end (not shown). One pulley is an idler pulley, while the other is driven by a motor 29. The motor 29 drives a common shaft (not shown) connected to the drive pulleys of each of the belts 23, 25 such that the belts 23, 25 will be driven at the same velocity to move around their respective idler and driven pulleys. Thus, as the belts 23, 25 move around the pulleys in the direction of arrow A, the guide wall 13 moves therewith so that the entire stack of mixed mail 5 is moved toward a nudger wall 31. As will be discussed in more detail below, the stack of mixed mail 5 will have individual mailpieces 3 moved from the stack of mixed mail 5 downstream so that the stack of mixed mailpieces 5 is continuously reduced in size. When the guide wall 13 has been moved to a point where it is desirable to add additional pieces of mixed mail to the stack 5, the guide wall 13 can be lifted out of the individual tracks 27 of the belts 23, 25 by pulling the guide wall 13 up to rotate, via the cylindrical portion 13*a*, about the guide rod 15. Once the bottom of the guide wall 13 is clear of the individual tracks 27 of the belts 23, 25, it can be slid backward in the opposite direction from that of arrow A and placed in a desired position to receive additional mixed mail. In an alternate embodiment, a single belt fitted with cogs may be used. In the alternate embodiment the mailpieces 3 in the stack of mixed mail 5 engages with the cogs on the belt and be driven toward the nudger wall 31.

Figure 3:
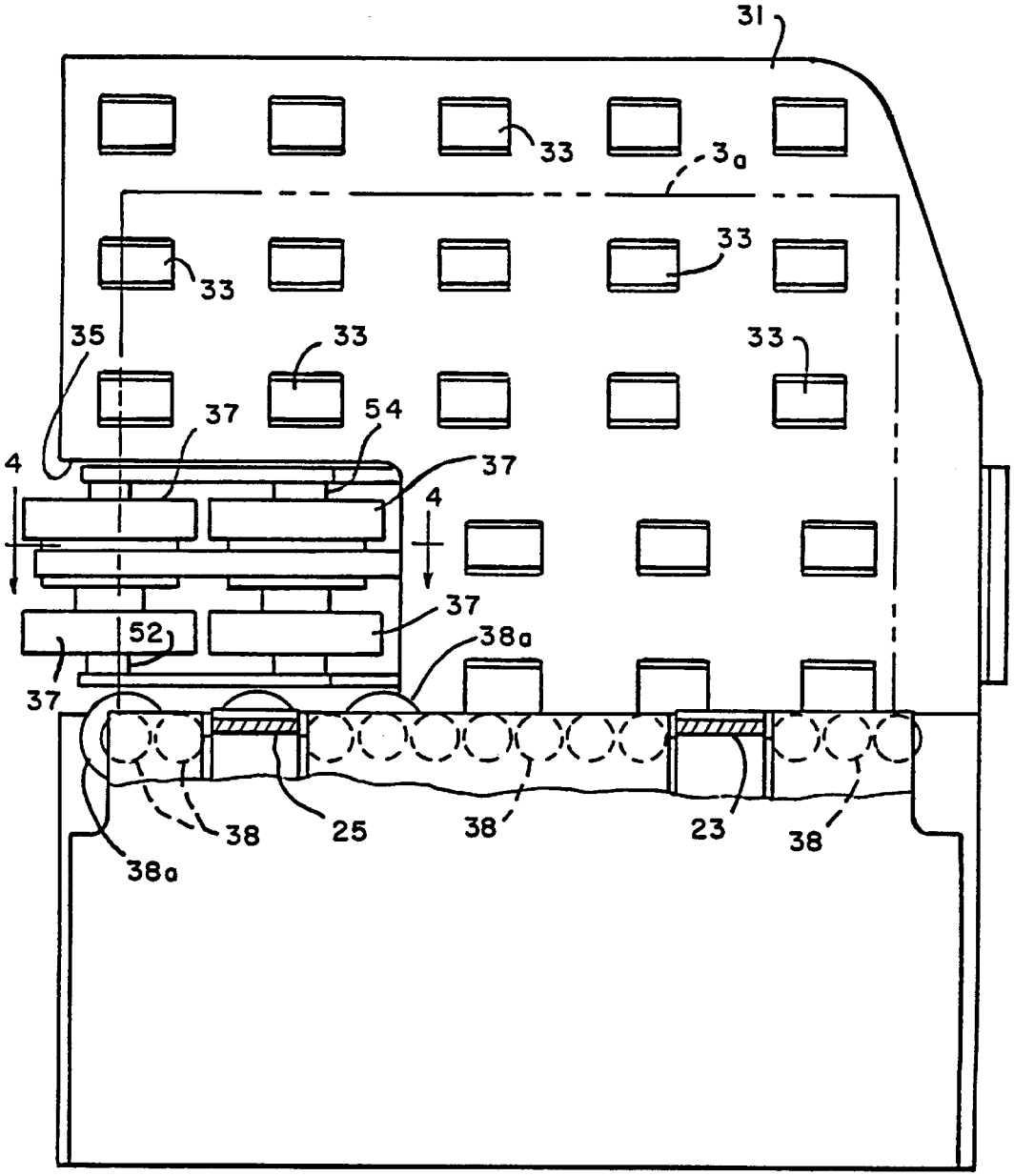
FIG. 3 is an enlarged detailed view of the nudger wall of FIG. 1.

Referring to FIGS. 1, 2, and 3, nudger wall 31 includes a plurality of rollers 33 mounted therein in a conventional manner to be freely rotatable. Furthermore, nudger wall 31 has a cutout 35 in a lower corner thereof through which driven nudger rollers 37 project. Moreover, a plurality of roller bars 38 are rotatably mounted in a conventional manner in a slot 40 of platform 10. Thus, as guide wall 13 pushes the stack of mixed mail 5 toward nudger wall 31, individual pieces of mail 3 fall off the end of belts 23, 25 on top of the rollers 38 and into contact with the nudger rollers 37. While in the preferred embodiment the roller bars 38 are not driven, they could be driven to provide additional forward feed force to the mailpiece 3. In one embodiment, a continuous belt 36 (shown in FIG. 5) is driven around the roller bars 38. Use of the continuous belt 36 provides a greater coefficient of friction as compared to the roller bars and thus 15 improves the feed force and provides for a simple drive structure. Additionally, the driven continuous belt 36 is helpful when mailpieces are being manually placed on the belt 36 since the drive helps to pull the mailpiece into the mixed mail feeder 1.

Figure 4:
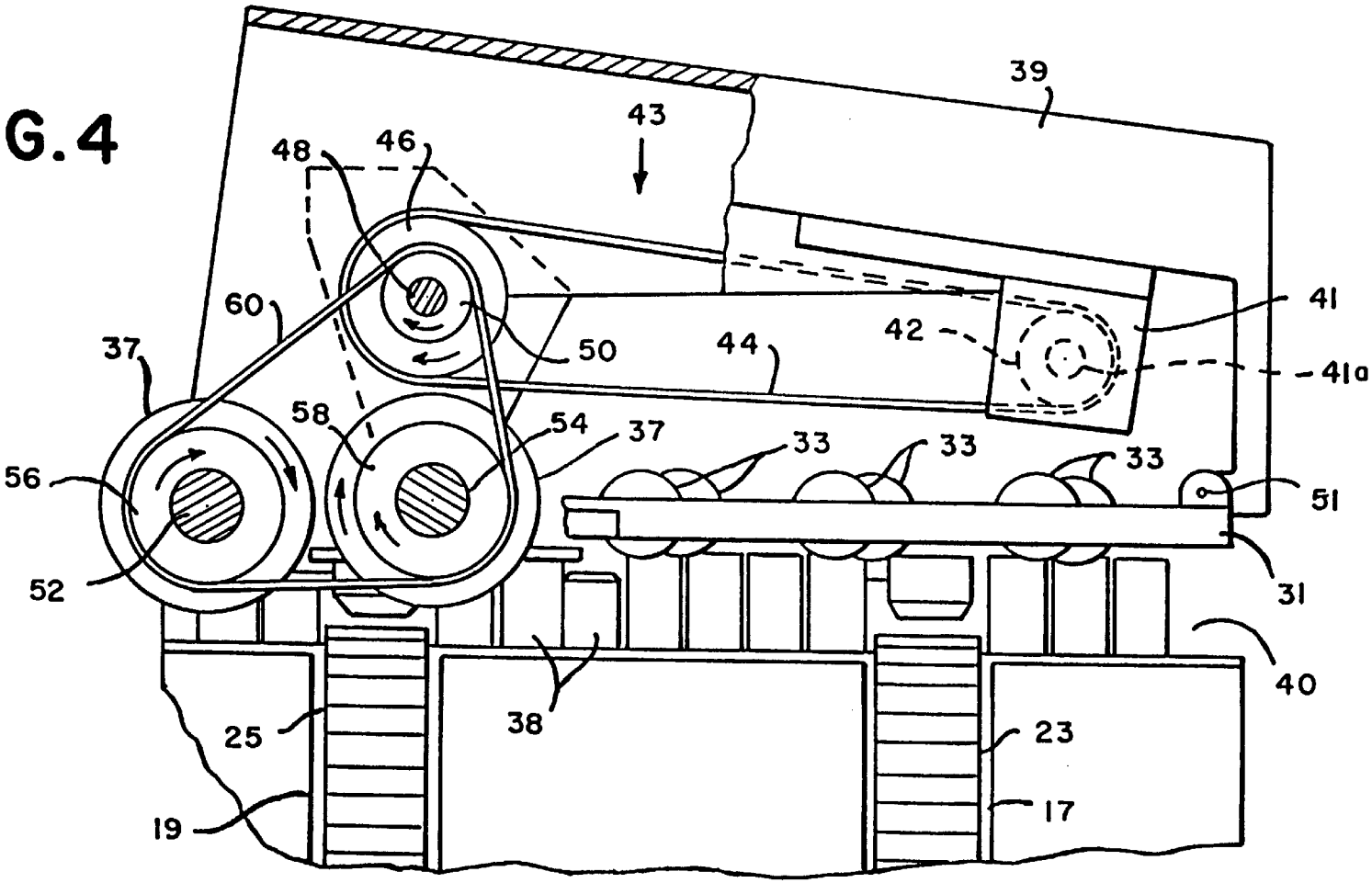
FIG. 4 is an enlarged top plan view partially in section along line V—V of FIG. 3 showing details of the nudger roller drive system.

The nudger rollers 37 are mounted to be driven into rotation within a nudger arm 39. The four nudger rollers 37 are driven together by a motor 41, mounted on nudger arm 39, via a drive train 43 as shown schematically in FIG. 2 and in detail in FIG. 4. As shown in FIGS. 2 and 4, all of the nudger rollers 37 are driven into rotation in a clockwise direction. Accordingly, as the stack of mixed mail 5 is moved toward nudger wall 31, the lead mailpiece 3*a* is forced into contact with the nudger rollers 37. The force of the driven nudger rollers 37 acts against the lead mailpiece 3*a* to move the mailpiece 3*a* in the direction of a conventional separator device 45, thereby shingling the lead mailpiece 3*a* from the stack of mixed mail 5 as shown in FIGS. 1 and 2. The shingled mailpiece is then transported to the nip of separator 45 which operates in a conventional manner to separate the lead mailpiece 3*a* from the shingled stack and deliver it to take-away rollers 65 which transport the individual lead mailpiece 3*a* further downstream to mail processing station 7. As is readily apparent to one skilled in the art, the microprocessor 61 controls all of the motors typically associated with the stack advance, shingling device, separator, and take away rollers and includes known clock structure for determining the predetermined time periods discussed above. The nudger rollers 37 continue to drive until a lead edge of the lead mail piece 3*a* is substantially through the separator device 45 where it is sensed by a sensor (not shown). Upon being sensed, the microprocessor 61 is signaled to stop the driving of the nudger roller 37. The nudger rollers 37 have an over running clutch (not shown). Mailpieces pulled by the separator device 45 freely rotate the nudger rollers 37. Disengaging the nudger rollers 37 reduces the amount of pullout force needed to pull the lead mailpiece 3*a* from the stack and produces less failures to feed.

Referring to FIGS. 3 and 4, the details of the drive system 43 are shown. Motor 41 has a shaft 41*a* connected to a pulley 42. A continuous belt 44 is disposed around pulley 42 and a second pulley 46. Pulley 46 is fixedly mounted to a rotatable shaft 48 mounted in nudger arm 39. Also, fixedly mounted to shaft 48 is a third pulley 50. Additional shafts 52, 54 are also rotatably mounted in nudger arm 39 and respectively have fourth and fifth pulleys 56, 58 fixedly mounted thereto. Nudger rollers 37 are mounted on a corresponding one of shafts 52, 54. Accordingly, as motor 41 rotates pulley 42 in the clockwise direction of FIG. 4, pulley 46 and hub 48 are driven in the clockwise direction as well. Since a continuous belt 60 passes around pulleys 48, 56, and 58, shafts 52, 54 are forced to rotate in the clockwise direction causing a corresponding rotational movement in all of nudger rollers 37.

In order for the nudger rollers 37 to effectively feed the stack of mixed mail 5 into the separator 45, accurate control of the normal force applied to the stack of mixed mail 5 by the interaction of the guide wall 13 and the nudger rollers 37 needs to be achieved. The normal force is created by a spring 49 that is fixedly mounted at one end to the nudger wall 31 and at its other end to a mounting platform 50 of nudger arm 39. The nudger arm 39 is pivotally mounted about a conventional pivot structure 51 so that the spring 49 biases the nudger rollers 37 through the cutout 35 and into contact with the lead mailpiece 3*a*. Thus, as the guide wall 13 is advanced in the direction of the nudger wall 31, the nudger arm 39 is forced to rotate in the clockwise direction of FIG. 2 around pivot structure 51 in opposition to the biasing force of the spring 49. As the spring 49 is extended due to the rotation of nudger arm 39 about the pivot structure 51, the force exerted by the spring 49 is continually increased by a known amount. The normal force is discussed in U.S. Pat. No. 5,971,391, assigned to the assignee of the present invention, and herein incorporated by reference.

A mechanism may be used to provide additional force in the situation where stalled mail is detected. That is, once the microprocessor 61 determines that a stall has occurred, utilization of a solenoid 71 (as shown in FIG. 2) provides additional normal force in an attempt to overcome the stalled situation. The solenoid 71 is fixedly mounted to the platform 9 and has one end fixedly mounted to a moveable plunger 75 of solenoid 71. When the nudger arm 39 is positioned in the normal force operating range, the plunger of the solenoid is not extended, thereby providing no additional normal force. However, when stalled mail is detected, the microprocessor 61 energizes the solenoid 71 to withdraw the plunger 75 such that the plunger 75 is extended to provide an additional normal force to the mixed mail stack 5 via the nudger rollers 37. The force applied by the solenoid 71 can be consistently applied for a predetermined period of time or can be pulsed to help the stalled mail break away. It should be noted that if the creation of additional normal force by the solenoid does not clear the stalled mailpieces, the noise created by the solenoid operation is a signal to the operator that a stall situation has occurred that needs to be manually resolved. The solenoid provides for efficient operation of the mail handling device, because it does not require shutting down the device each time a stall occurs but rather attempts automated resolution of the stall.

Figure 5:
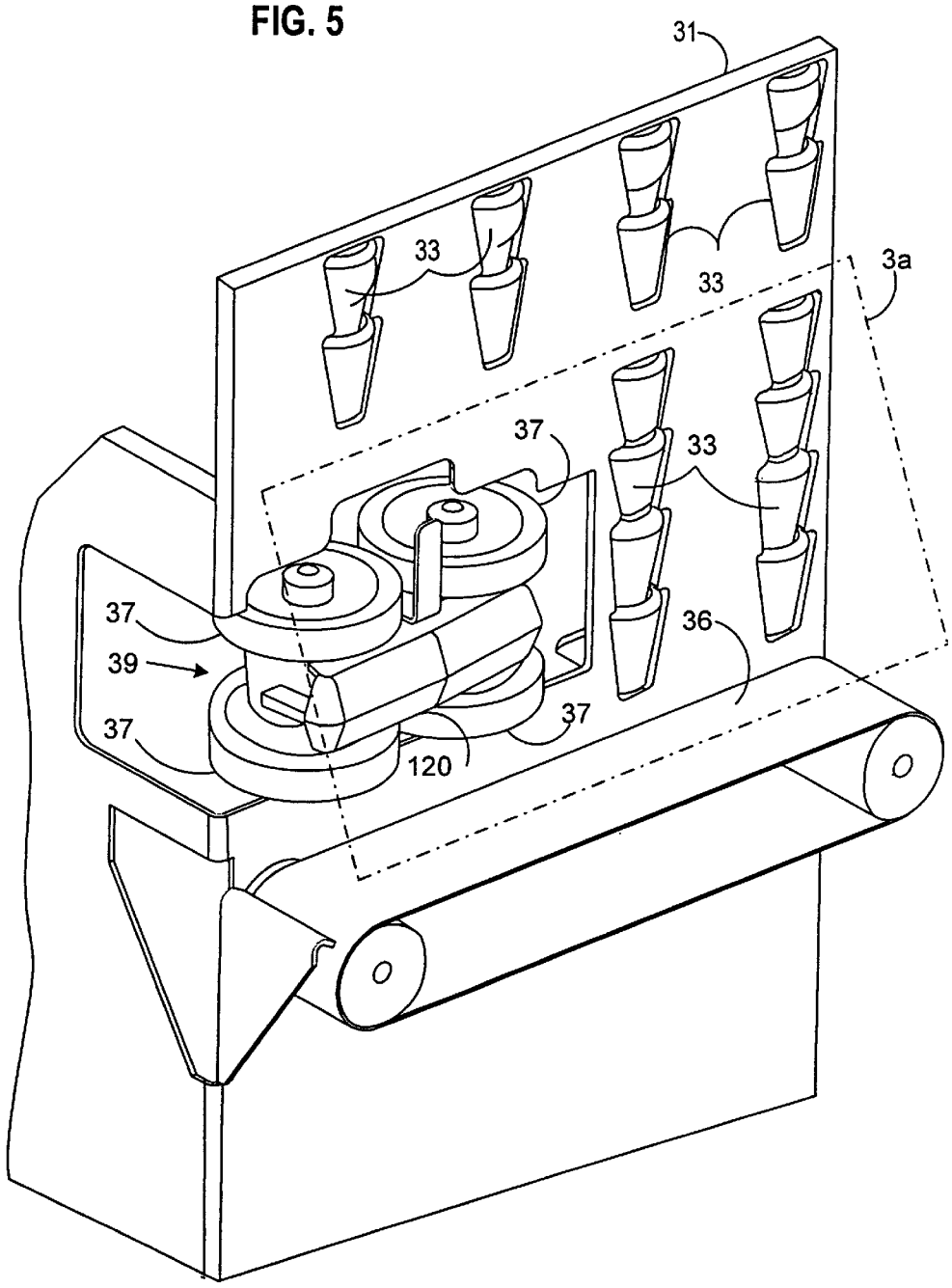
FIG. 5 is a perspective view of a portion of the mail handling machine illustrating an embodiment with a lean detection arm, tapered nudger rollers, a continuous belt and a leaning lead mailpiece (with dashed lines).
Figure 6:
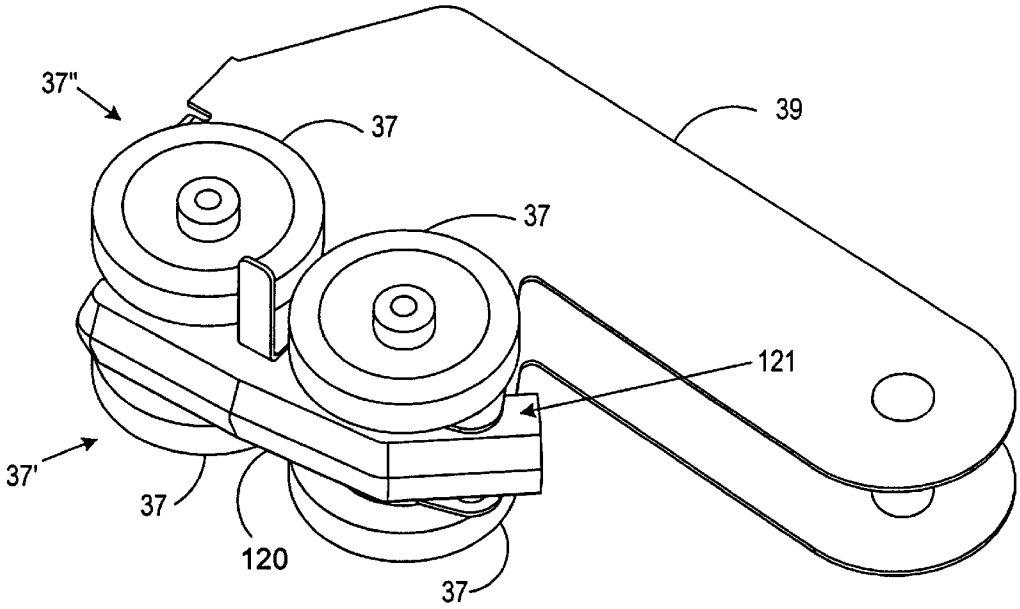
FIG. 6 is a perspective view of a portion of the mail handling machine of FIG. 5 illustrating the nudger arm, the lean detection arm and the nudger rollers.
Figure 7:
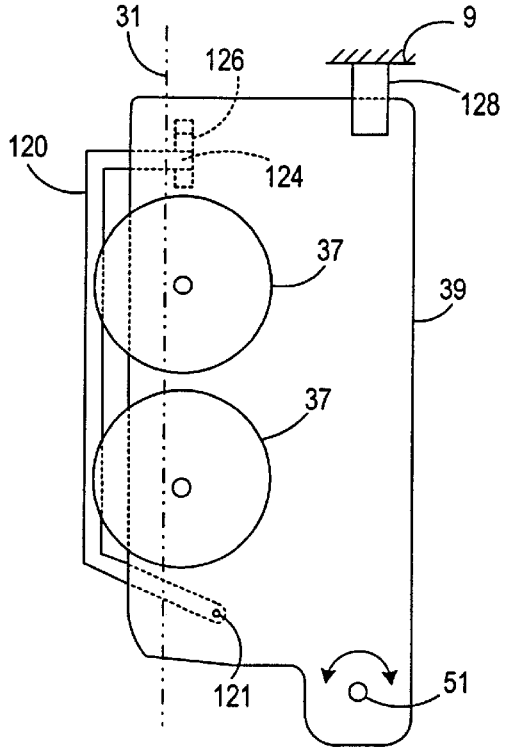
FIG. 7 is a simplified top view of the portion of the mail handling machine of FIG. 5.
Figure 8:
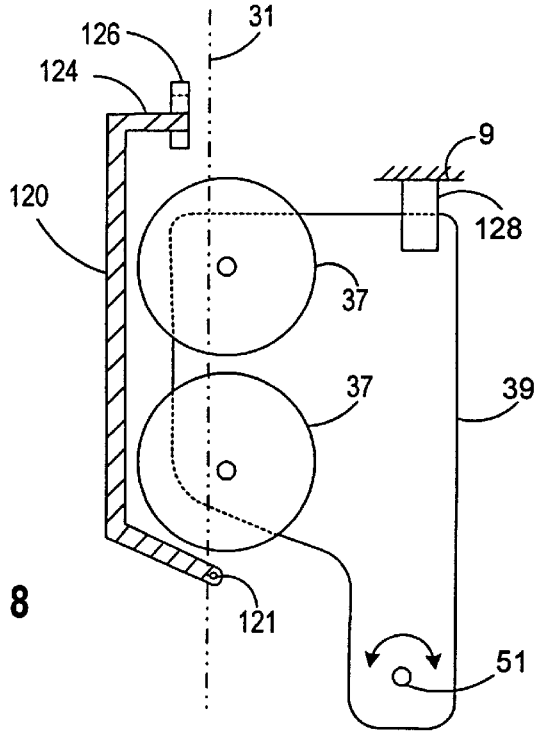
FIG. 8 is an alternate embodiment of the simplified top view of FIG. 8 illustrating an alternate configuration of the lean detection arm.

As shown in the perspective view of FIG. 5, the nudger arm 39 further comprises a lean detection arm 120 for detecting the position of the lead mailpiece 3*a*. FIG. 6*a* illustrates a simplified perspective view of the nudger arm 39, nudger roller 37 and lean detection arm 120 configuration. The lean detection arm 120 is positioned between the first and second rows, 37' and 37" respectively, of nudger rollers 37. The lean detection arm 120 is spring biased (not shown) in a counter clockwise direction and is pivotally mounted about a conventional pivot structure 121 such that the arm is movable being movable between an extended position and a compressed position of the spring. FIG. 7 illustrates a finger 124 projecting from the lean detection arm 120. The finger 124 aligns with a through-beam sensor 126 (lean detection sensor) mounted on the nudger arm 39 when the lean detection arm 120 is in the position where it has been rotated clockwise, and the biasing spring has been compressed. In an alternate embodiment, shown in FIG. 8, the lean detection arm 120 and through-beam sensor 126 may be fixedly mounted, for example, on table 9 or other suitable adjacent stationary portion of the mail handling device. When the through beam sensor is blocked by the finger 124, a signal is sent to the controller indicating that the lead mailpiece 3*a* is in a preferred position, that is the lead mailpiece 3*a* has the proper lean for feeding. In this embodiment, the maximum allowable lean angle that a mailpiece can have with respect to the nudger wall 31 is dependent upon the position of the nudger rollers 37. Whereas in the embodiment where the lean detection arm 120 pivot structure is mounted on the nudger arm 39 (as shown in FIG. 7), the maximum allowable lean angle is independent of the position of the nudger rollers 37. Additionally, mounting the lean detection arm 120 on the nudger arm 39, as illustrated in FIG. 7, allows for easier access to the lead detection arm, because the nudger arm 39 can swing outward and away from the nudger wall 31.

Figure 9A:
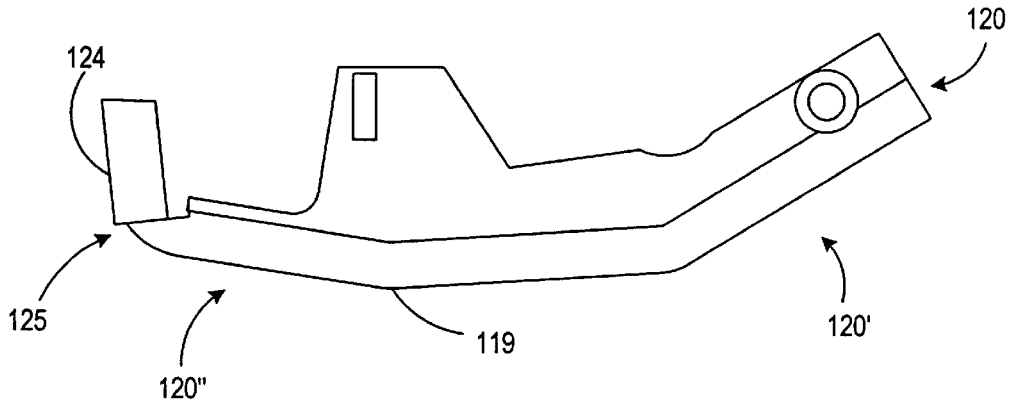
FIG. 9*a* is a top view of the lean detection arm.
Figure 9B:
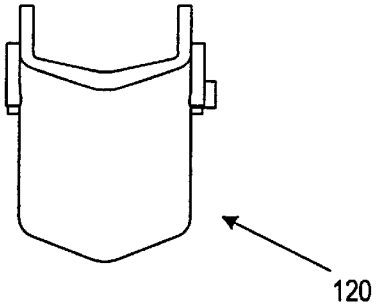
FIG. 9*b* is a right side view of the lean detection arm.

The geometry of the lean detection arm 120 illustrated in FIG. 9*a*, assists in the detection and proper feeding of mailpieces of various sizes. The lean detection arm 120 comprises a first end 120' and a second end 120". The first end 120' is configured for mounting with the conventional pivot structure 121. The second end comprises a trigger point 119, a flag 124 and a ridge adjacent to the flag 124. The geometry provides for more accurate detection of short mailpieces such as postcards and allows the mailpieces to hold the lean detection arm 120 in the sensed position as they are being fed into the separator or other downstream processing device. As they are being fed downstream, the mailpieces 3 travel between the trigger point 119 and the ridge 125 causing the normal force to be maintained against the lean detection arm 120. Additionally, the geometry of the lean detection arm 120 (further illustrated in the right side view of FIG. 9*b*) allows for manual feeding of mailpieces 3 which may be slid into the nudger area from behind the first end of the lean detection arm 120 or may be dropped into the nudger area from above the lean detection arm 120. In either case, the angling of the lean detection arm 120 allows the manual feeding without providing harsh edges on the lean detection arm 120 which may catch and/or damage the mailpieces 3 or the lean detection arm 120.

For proper feeding, the nudger arm 39 is preferred to be in a particular position that allows the mailpieces 3 to be fed down stream without stubbing on downstream devices such as the separator device 45 or on a guide plate 6 (shown in FIG. 2). The position of the nudger arm 39 is sensed using a through-beam sensor 128 (stack advance sensor) which is preferably fixedly mounted on the table 9 or other suitable adjacent stationary portion of the mail handling device. When the nudger arm 39 rotates in a clockwise direction as the mailpiece is advanced in the direction of the nudger wall 31, the nudger arm 39 blocks the through beam sensor 128, and a signal is sent to the microprocessor 61 indicating that the lead mailpiece 3*a* is in a preferred position for feeding.

Figure 10A:
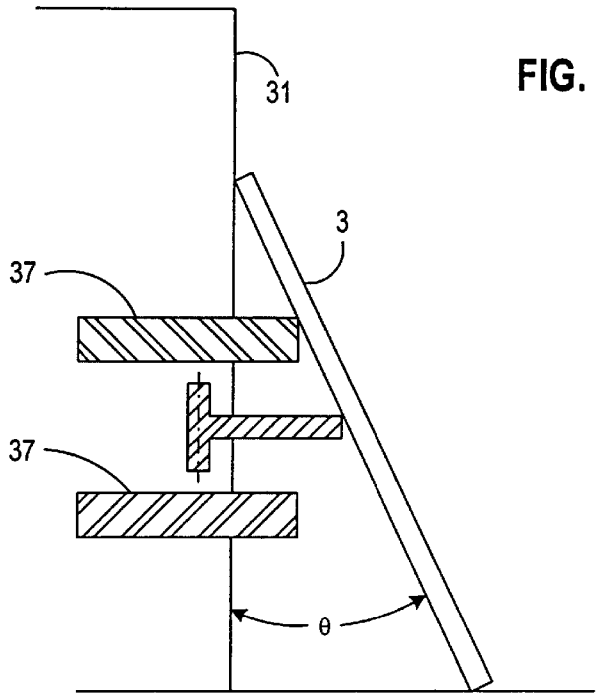
FIG. 10*a* is a simplified front view of an embodiment of the mail handling machine illustrating mailpiece lean (inward against the nudger wall) against the lean detection arm of FIG. 5.
Figure 10B:
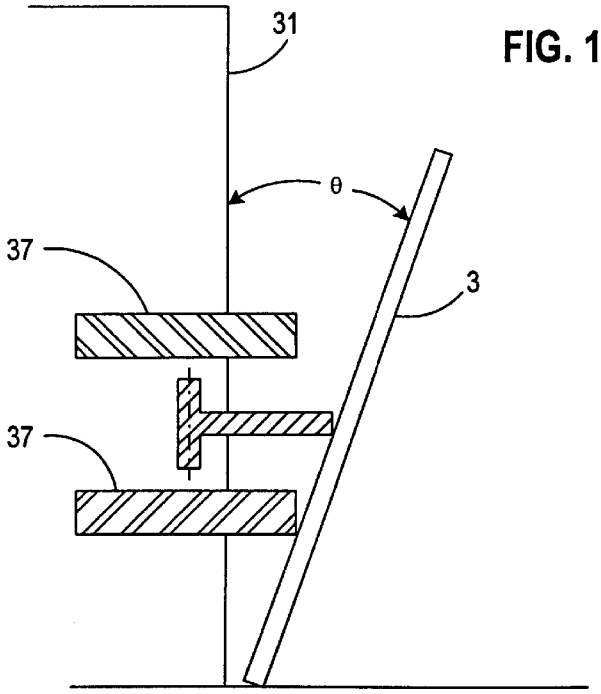
FIG. 10*b* is a simplified front view of an embodiment of the mail handling machine illustrating mailpiece lean against the lean (outward away from the nudger wall) detection arm of FIG. 5.

FIGS. 10*a* and 10*b* illustrate the position of the lead mailpiece 3*a* and acceptable angle with respect to the wall 31. In order for the mailpiece to be moved by the nudger rollers 37, the mailpiece must cause the nudger arm 39 and the lean detection arm 120 to be in a compressed position and that position must be sensed by sensors 126 and 128. This position may happen when the angle θ between the mailpiece and the nudger wall 31 is in a range of about 0 to 1.5 degrees when the mailpiece is leaning toward the wall as shown in FIG. 10*a*, and in a range of about 0 to 8 degrees when the mailpiece is leaning away from the wall as shown in FIG. 10*b*. The angles correspond to the angle of the guide plate 6 at the entrance of the separator (shown in FIG. 5). That is, the guide plate 6 is preferably at an angle of about 8 degrees to vertical to help prevent stubbing when mailpieces are fed in a "lean away" position.

Figure 11:
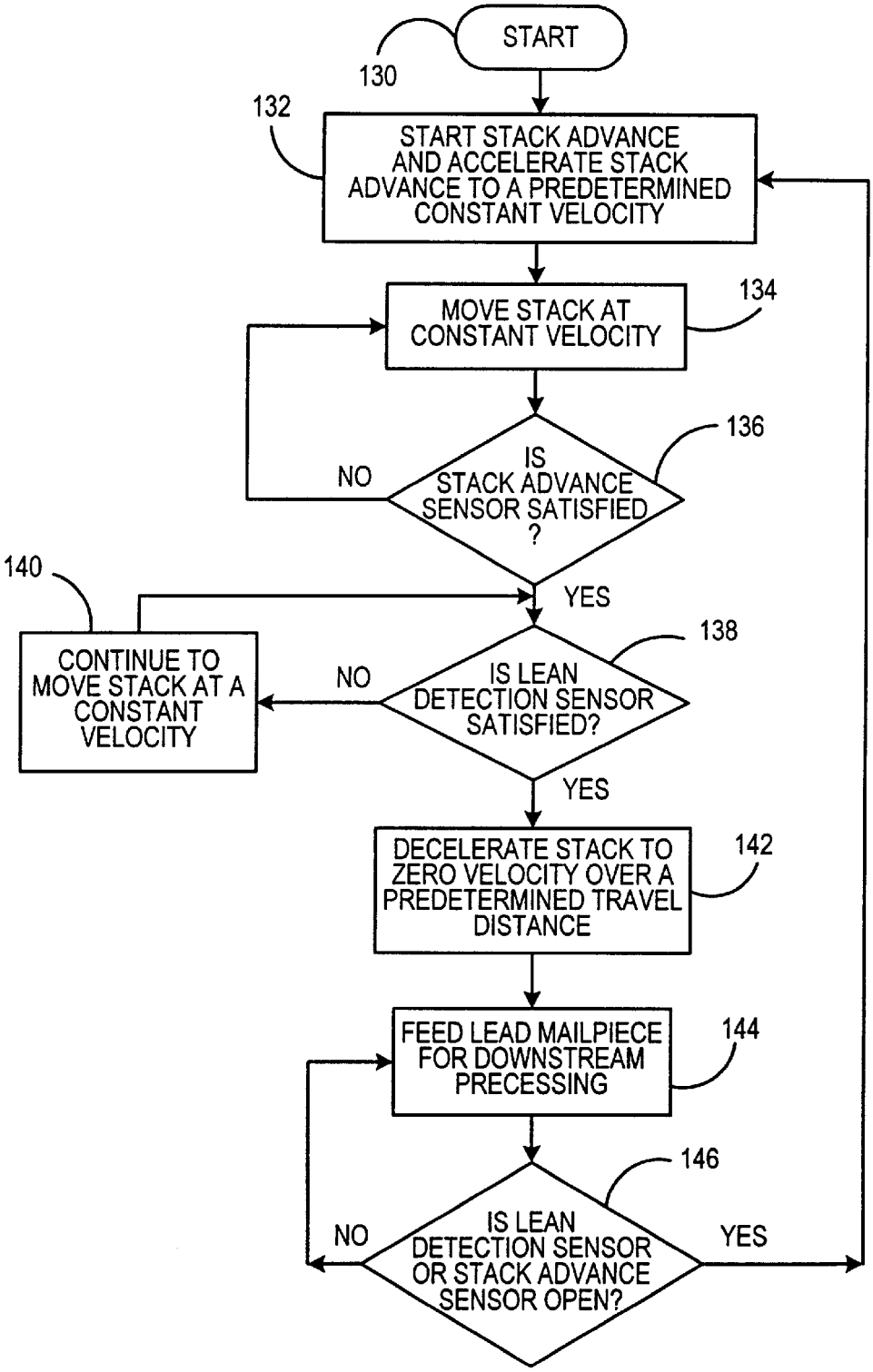
FIG. 11 is a flowchart illustrating the method of accelerating and decelerating the stack of mailpieces.

FIG. 11 is a flowchart illustrating the steps of advancing the stack of mixed mail 5 towards the nudger arm 39 and lean detection arm 120, feeding the mailpieces 3 and controlling the stack advance. At step 130, the method begins. At step 132, the stack of mixed mail 5 is advanced in the direction of the nudger and accelerated to a predetermined velocity. At step 134, the stack of mixed mail 5 continues to advance at a constant velocity. At step 136 a query is made as to whether the stack advance sensor 128 is blocked or satisfied. If at step 136, the stack advance sensor is not satisfied, then step 134 is repeated, and the stack of mixed mail 5 continues to advance at constant velocity. Next, at step 138, a query is made as to whether the lean detection sensor is satisfied or blocked. If at step 138, the lean detection sensor 126 is not satisfied, then at step 140, the stack of mixed mail 5 continues to advance at a constant velocity. If at step 138, the lean detection sensor 126 is satisfied, then at step 142, the stack of mixed mail 5 is decelerated to a stop over a predetermined distance of stack travel. The predetermined distance causes some over-travel of the mailpiece and helps to ensure that the mailpiece is in contact with the nudger rollers 37. Next, at step 144, the nudger rollers 37 are driven, and the lead mailpiece 3*a* is fed down stream for further processing. At step 144, a query is made as to whether the lean detection sensor 126 or the stack advance sensor 128 are still satisfied. If at step 146, both sensors continue to be satisfied (an indication that there is a mailpiece in the preferred position for feeding), then step 144 is repeated, and the nudger rollers 37 feed the next mailpiece down stream for processing. If one or both of the lean detection sensor and the stack advance sensor is not satisfied, then the method returns to step 132, and the stack advance accelerates. Steps 134-146 are repeated as explained above. Thus, feeding downstream is enabled in a range from the sensor trigger point to the over travel position.

Figure 12:
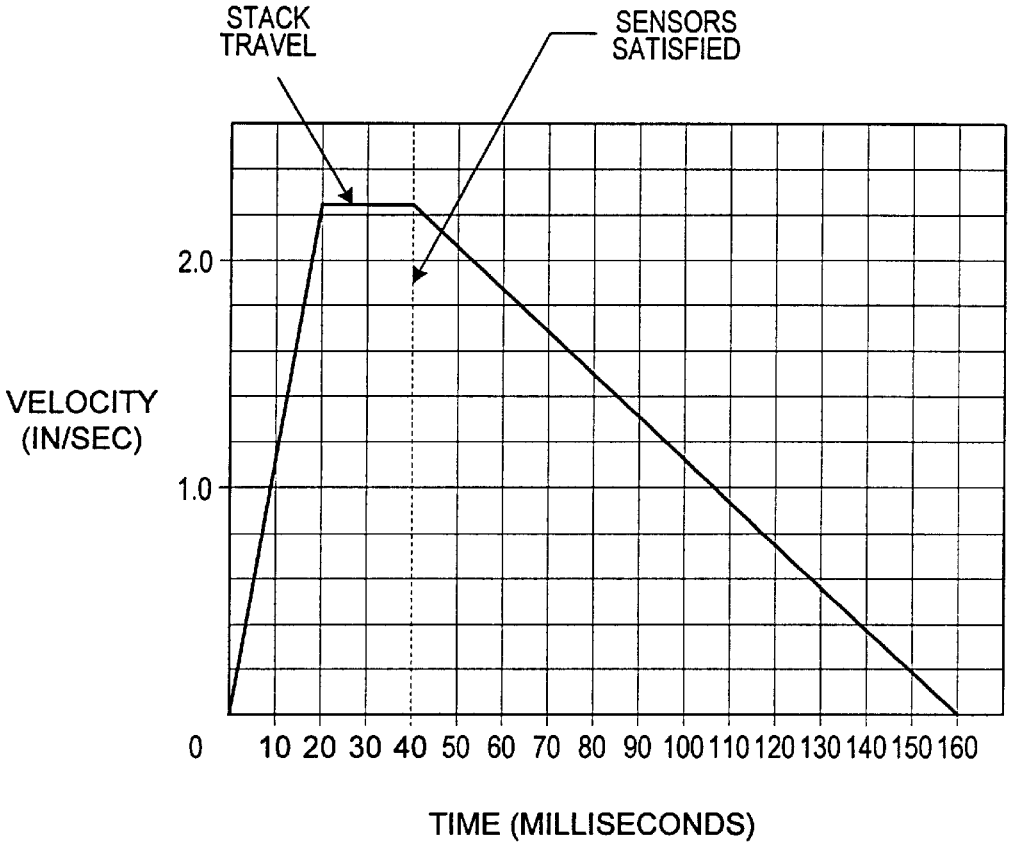
FIG. 12 is a time v. velocity graph illustrating the movement of the advancing stack of mailpieces.

FIG. 12 illustrates a preferred stack advance profile in a plot of time verses velocity. As can be seen from the graph, the stack of mixed mail 5 is accelerated very rapidly to a constant velocity and once the sensors 126, 128 become blocked the stack of mixed mail 5 is decelerated more gradually to a stop. The gradual deceleration of the stack of mixed mail 5 helps to prevent toppling of the stack of mixed mail 5 toward the nudger wall 31. If the stack of mixed mail 5 topples toward the nudger wall 31, the stack normal force will be great and can cause the mailpieces 3 to stall because the nudger rollers 37 may not be able to overcome the stack normal force and shingle the lead mailpiece 3*a* from the front of the stack of mixed mail 5. The gradual deceleration is chosen to produce an over travel of the mailpieces 3 after the sensors 126, 128 are satisfied. This ensures good contact with the nudger rollers 37 for feeding downstream. If the over travel is too great, the interdocument forces in the stack of mixed mail 5 becomes too great and the mailpieces 3 may not be fed. If the over travel is too little, the lead mailpiece 3*a* may not have enough contact with the nudger rollers 37 for proper feeding, or the leaning stack may be creating too much force on the lead mailpiece which is also leaning. The stack advance profile may be determined by one of ordinary skill in the art.

Additional advantages and modifications will readily occur to those skilled in the art. Therefore, the invention in its broader aspects is not limited to the specific details and representative devices shown and described herein. Accordingly, various modifications may be made without departing from the spirit or scope of the general inventive concept as defined by the appended claims.

What is claimed is:

1. An apparatus for detecting lead mailpiece position in a nudger for a mail handling system which processes a stack of mail along a feed path, the apparatus comprising:

a wall comprising a cutout for accommodating a first arm;

the first arm biased toward the lead mailpiece and mounted to be received through the cutout in the wall, the first arm for sensing position of a lead mailpiece of the stack of mail;

a first sensor for detecting when the first arm is in a position for proper feeding of the lead mailpiece along the feed path;

a second arm positioned on the first arm for detecting lean of the lead mailpiece in the stack of mixed mail; and a sensor for detecting when the second arm is in a position for proper feeding of the lead mailpiece along the feed path;

whereby when the first sensor detects that the first arm is in a position for proper feeding of the lead mailpiece along the feed path and the second arm is in a position for proper feeding of the lead mailpiece along the feed path, the mailpiece is fed downstream along the feed path.

2. The apparatus as claimed in claim 1 further comprising:

a driven belt mounted adjacent to and at a lower edge of the wall along the mailpiece feed path for pulling on the lead mailpiece along the mailpiece feed path.

3. An apparatus for detecting lead mailpiece position in a nudger for a mail handling system which processes a stack of mail, the apparatus comprising:

a wall comprising a cutout for accommodating a first arm;

the first arm spring biased toward the lead mailpiece and pivotally mounted about a pivot structure such that the first arm being movable between first and second positions and through the cutout in the wall, the first arm for applying a feed force to a lead mailpiece of the stack of mail to feed the lead mailpiece of the stack along a mailpiece feed path, the first arm comprising a finger which projects from the first arm for alignment with a first sensor when the first arm is in the second position;

first and second rows of driven rollers mounted on the first arm, each of the first and second rows of the driven rollers comprising a plurality of driven rollers, each of the driven rollers in the first row of driven rollers mounted in axial alignment with one of the driven roller in the second row of driven rollers;

a second arm, pivotally mounted about a pivot structure such that the arm being movable between first and second positions, the second arm positioned between the first and second row of driven rollers, the second arm comprising a finger which projects from the second arm for alignment with a second sensor when the second arm is in the second position;

a stack advance mechanism for moving the stack of mail so that a face of the lead mailpiece contacts the first and second row of driven rollers and the second arm;

wherein at times when at least one of the first and second arms is not in the second position, the stack advance mechanism moves the stack of mail in the direction of the first arm causing the first arm to move toward the second position and the second arm to move toward the second position;

wherein at times when the first and second arms are in the second position, the first and second rows of driven rollers move the lead mailpiece away from the stack of mail along the mailpiece feed path thereby continuously reducing the size of the stack of mail and causing the first and second arms to gradually move towards the first positions and stack forces to gradually decrease; and whereby a range of acceptable feeding which controls normal force of the stack of mixed mail and angle of the stack of mixed mail is controlled by travel amount of the stack of mixed mail and the position of the first and second arms.

4. The apparatus as claimed in claim 3 wherein the pivot structure of the second arm is mounted on a deck.

5. The apparatus as claimed in claim 3 wherein the second arm further comprises a ridge positioned adjacent to the finger, the ridge for contact with an edge of the lead mailpiece, for holding the second arm in the second position while the stack of mail is being processed.

6. The apparatus as claimed in claim 3 wherein the pivot structure of the second arm is mounted on the first arm adjacent to the pivot structure of the first arm.

7. The apparatus as claimed in claim 3 further comprising:

a driven belt mounted adjacent to and at a lower edge of the wall along the mailpiece feed path for pulling on the lead mailpiece along the mailpiece feed path.

8. The apparatus as claimed in claim 3 wherein the second sensor is mounted on the first arm.

9. A method for detecting lead mailpiece position in a nudger for a mail handling system which processes a stack of mail, the method comprising the steps of:

a) accelerating the stack of mail to a predetermined velocity and in a direction toward the nudger for the mail handling system;

b) moving the stack of mail at the predetermined velocity toward the nudger for the mail handling system;

c) determining whether the lead mailpiece of the stack of mail has moved to a predetermined position in engagement with the nudger for the mail handling system;

d) determining whether the lead mailpiece of the stack of mail is positioned at an appropriate angle to the nudger for the mail handling system; and e) decelerating the stack of mail to a predetermined velocity while causing the stack of mail to travel a predetermined amount.

10. The method as claimed in claim 9 wherein in step (e) the predetermined velocity that the stack of mail is decelerated to is zero.

* * * * *